US007207779B2

(12) United States Patent
Horng et al.

(10) Patent No.: US 7,207,779 B2
(45) Date of Patent: Apr. 24, 2007

(54) IMPELLER FOR RADIAL-FLOW HEAT DISSIPATING FAN

(75) Inventors: Alex Horng, Kaohsiung (TW); Yu-Yuan Lu, Kaohsiung (TW); Mei-Chih Fang, Kaohsiung (TW)

(73) Assignee: Sunonwealth Electric Machine Industry Co., Ltd. (TW)

( * ) Notice: Subject to any disclaimer, the term of this patent is extended or adjusted under 35 U.S.C. 154(b) by 182 days.

(21) Appl. No.: 10/920,384

(22) Filed: Aug. 18, 2004

(65) Prior Publication Data

US 2006/0039783 A1 Feb. 23, 2006

(51) Int. Cl.
*F01D 5/22* (2006.01)

(52) U.S. Cl. ..... 416/186 R

(58) Field of Classification Search ..... 415/206; 416/185, 186 R, 223 B, 228, 234, 243
See application file for complete search history.

(56) References Cited

U.S. PATENT DOCUMENTS

| | | | | | |
|---|---|---|---|---|---|
| 1,243,615 | A * | 10/1917 | Liggett | 415/227 |
| 3,479,017 | A * | 11/1969 | Thikotter | 261/91 |
| 4,904,158 | A * | 2/1990 | Kun | 416/183 |
| 5,360,317 | A * | 11/1994 | Clausen et al. | 415/206 |
| D443,281 | S * | 6/2001 | Sodergard | D15/7 |
| 6,893,218 | B2 * | 5/2005 | Ito | 415/198.1 |

* cited by examiner

*Primary Examiner*—Edward K. Look
*Assistant Examiner*—Devin Hanan
(74) *Attorney, Agent, or Firm*—Bacon & Thomas PLLC

(57) ABSTRACT

An impeller for a radial-flow heat dissipating fan includes a hub and a plurality of blades surrounding the hub. The blades are connected to a circumference of the hub to allow joint rotation of the hub and the blades. The impeller includes an air inlet side and a bottom side. Distribution of the blades at the air inlet side of the impeller is sparser than that at the bottom side of the impeller, thereby increasing an air inlet amount.

20 Claims, 7 Drawing Sheets

IMPELLER FOR RADIAL-FLOW HEAT DISSIPATING FAN

BACKGROUND OF THE INVENTION

1. Field of the Invention

The present invention relates to an impeller for a radial-flow heat dissipating fan. In particular, the present invention relates to an impeller for a radial-flow heat dissipating fan with increased air inlet amount.

2. Description of Related Art

FIG. 1 of the drawings illustrates a conventional radial-flow heat dissipating fan. The radial-flow heat dissipating fan in FIG. 1 comprises a casing 1 and a cover 2. The casing 1 includes a compartment 11 and a side outlet 12. The cover 2 is mounted to the casing 1 and includes an inlet 21. An impeller 3 is rotatably mounted in the compartment 11 of the casing 1 and includes a hub 31, a supporting member 32 extending from the hub 31, and a plurality of blades 33 each having an edge mounted on a side of the supporting member 32.

FIG. 2 illustrates another conventional radial-flow heat dissipating fan, wherein a connecting ring 34 extends across the other edges of the blades 33 to improve the strength. In operation, turning of the blades 33 of the impeller 3 drives axial airflow into the casing 1 via the inlet 21 of the cover 2. Then, the axial airflow is driven by the blades 33 to exit the casing 1 via the side outlet 12 for dissipating an object such as a fin.

Although the above radial-flow heat dissipating fans are widely used in computers, there are still several problems. First, the other edge 33*a* of each blade 33 is located at the same level as a top face of the hub 31. After assembly, the top face of the hub 31 is very close to the inlet 21 of the cover 2. Thus, the incoming air can only pass through the inlet 21 via the gap between the blades 33, resulting in limitation to the amount of the incoming axial airflow. In this case, if the other edge 33*a* of each blade 33 has a relatively long radial length, the other edge 33*a* interferes with entrance of the incoming axial airflow via the inlet 21. The air inlet amount could not be increased, the air outlet amount and the wind pressure are reduced. Secondly, if the other edge 33*a* of each blade 33 has a relatively long radial length, the incoming axial airflow entering the casing 1 via the inlet 21 is directly guided by the rotation of the edge 33*a* and thus turns into centrifugal airflow, leading to blowing noise and adversely affect to the rotational efficiency of the impeller.

OBJECTS OF THE INVENTION

An object of the present invention is to provide an impeller for a radial-flow heat dissipating fan for increasing air inlet area.

Another object of the present invention is to provide an impeller for a radial-flow heat dissipating fan for increasing outlet wind pressure.

SUMMARY OF THE INVENTION

In accordance with an aspect of the present invention, an impeller for a radial-flow heat dissipating fan comprises a hub, a plurality of blades surrounding the hub, and means for connecting the blades to the circumference of the hub, allowing joint rotation of the hub and the blades. The impeller includes an air inlet side and a bottom side. Distribution of the blades at the air inlet side of the impeller is sparser than that at the bottom side of the impeller, thereby increasing an air inlet amount.

Each blade includes an air inlet side edge and a bottom edge. In an embodiment, the air inlet side edges of the blades have different axial levels to form the sparser distribution of the blades at the air inlet side of the impeller. In another embodiment, the blades include a plurality of upper blades and a plurality of lower blades more than the upper blades to form the sparser distribution of the blades at the air inlet side of the impeller. A connecting ring is provided to separate the upper blades from the lower blades.

Some of the blades have an axial level higher than the hub, forming a buffering space between the blades and a top face of the hub for increasing the air inlet area and for assisting in change of axial incoming airflow into centrifugal airflow.

In an embodiment, a connecting ring extends across the air inlet side edge of each blade, and a connecting ring extends across the bottom edge of each blade.

At least one supporting member is connected between the circumference of the hub and at least one of the blades.

In a further embodiment, the impeller comprises an annular plate extending from the circumference of the hub, and the blades are mounted on a side of the annular plate.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
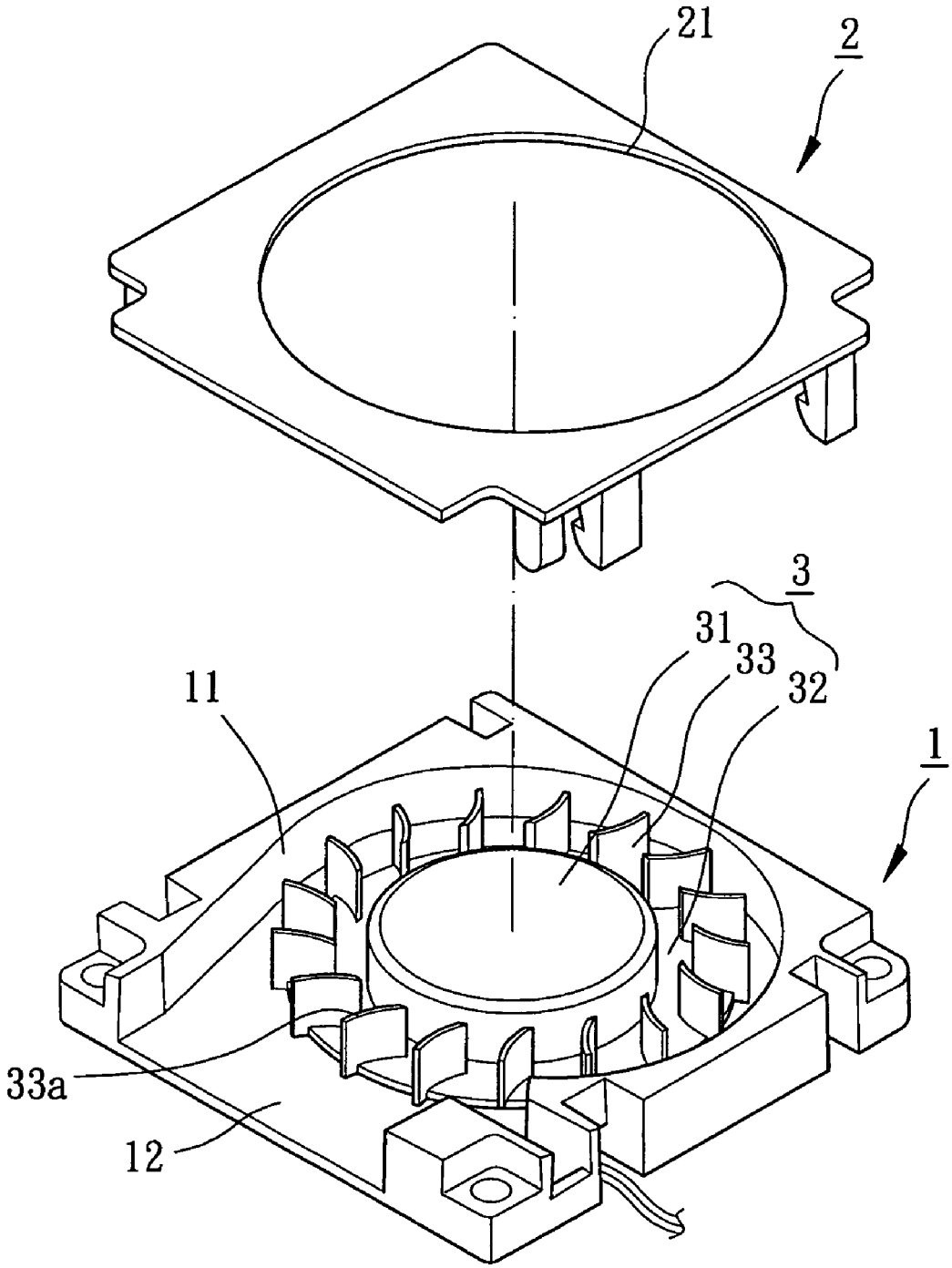
FIG. 1 PRIOR ART
FIG. 1 is an exploded perspective view of a conventional radial-flow heat dissipating fan.
Figure 2:
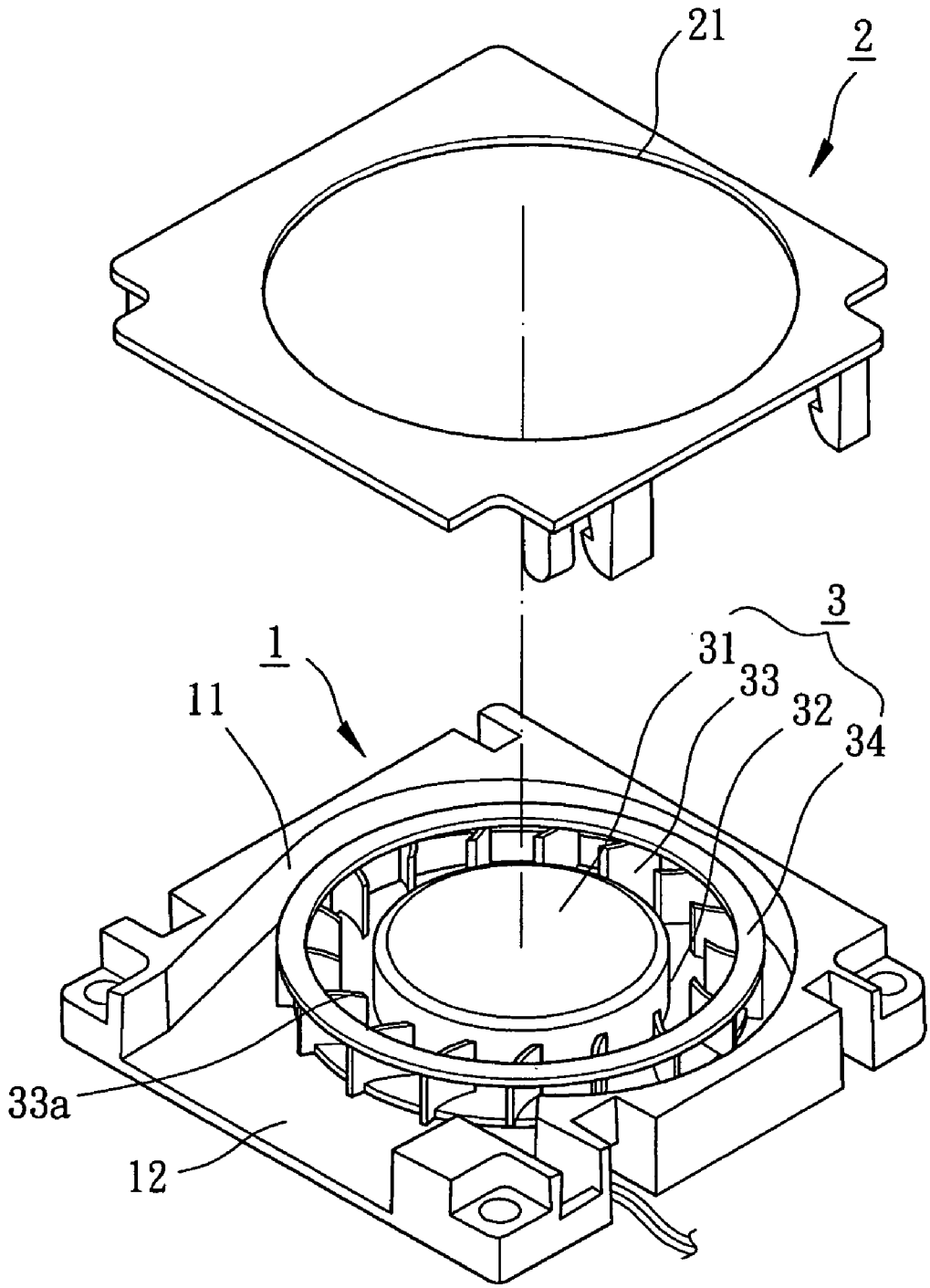
FIG. 2 PRIOR ART
FIG. 2 is an exploded perspective view of another conventional radial-flow heat dissipating fan.
Figure 3:
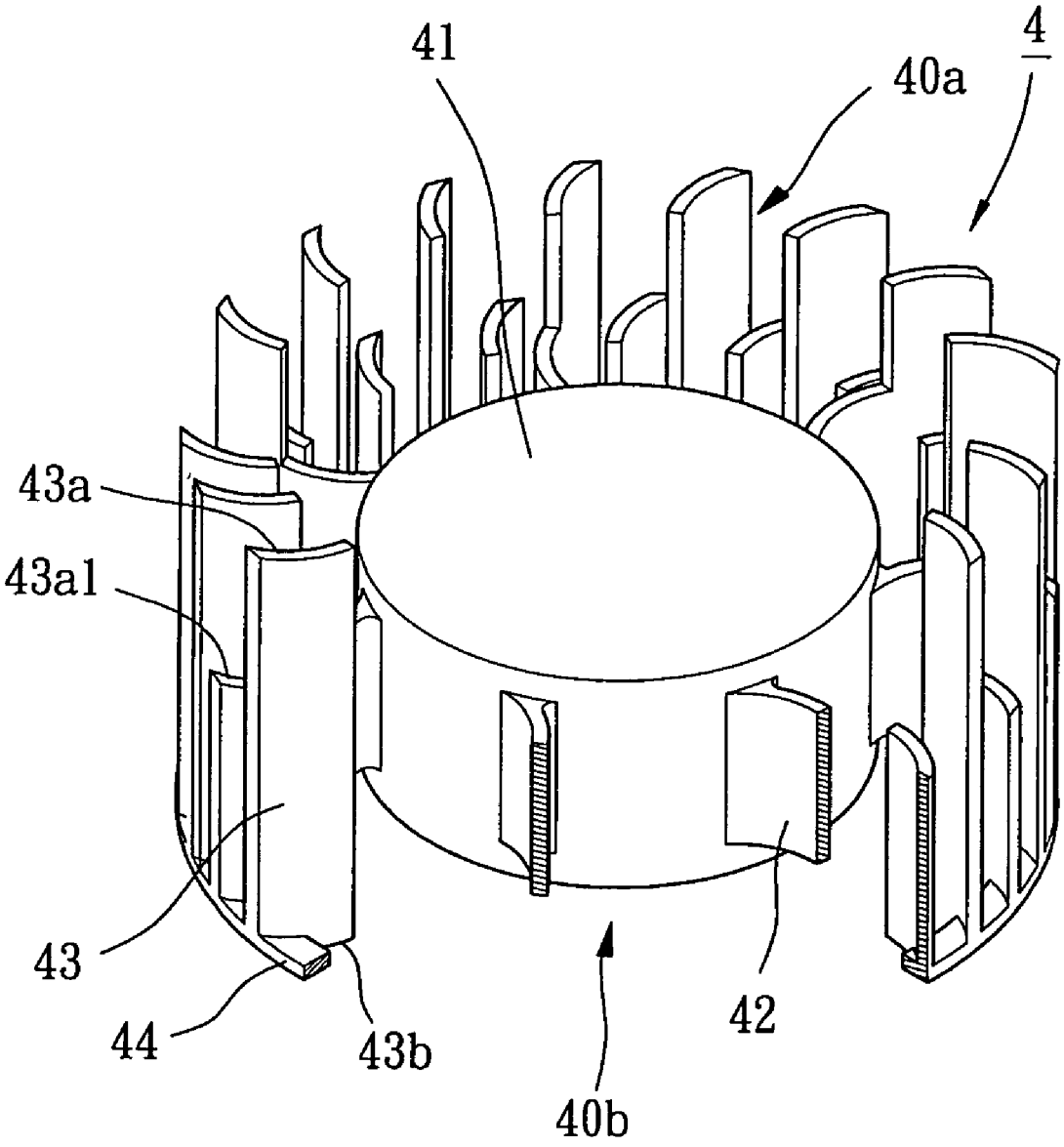
FIG. 3 is a perspective view, partly cutaway, of a first embodiment of an impeller for a radial-flow heat dissipating fan in accordance with the present invention.
Figure 4:
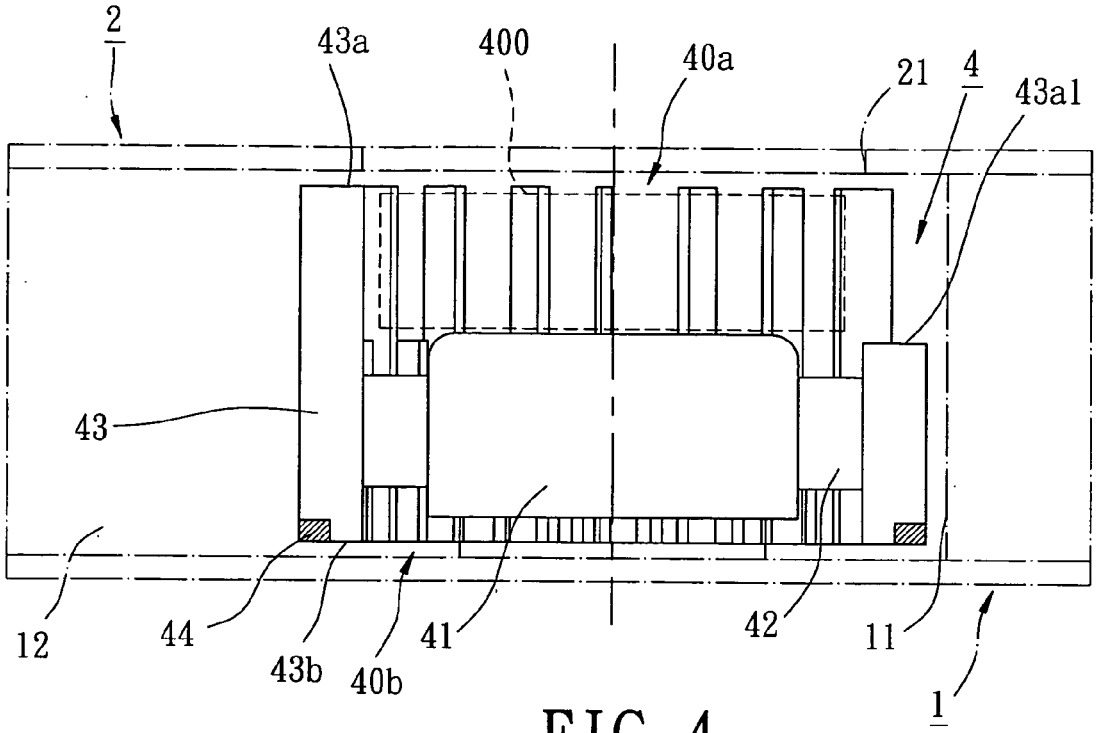
FIG. 4 is a side view of the impeller in FIG. 3.

Referring to FIGS. 3 and 4, a first embodiment of an impeller 4 in accordance with the present invention comprises a hub 41, at least one supporting member 42, a plurality of blades 43, and a connecting ring 44. The impeller 4 may be coupled with a motor (not shown) and assembled with a casing 1 and a cover 2 (see FIGS. 1 and 2) to form a complete radial-flow heat dissipating fan. The motor is mounted inside the hub 41 that is rotatably mounted in a compartment 11 in the casing 1. The impeller 4 includes an air inlet side 40*a* adjacent to the inlet 21 of the cover 2 and a bottom side 40*b* opposite to the air inlet side 40*a*. In this embodiment, a plurality of supporting members 42 are provided, with each supporting member 42 being connected between a circumference of the hub 41 and an associated one of the blades 43. Preferably, each supporting member 42 is a wave-like rib extending from the circumference of the hub 41 to the associated blade 43. A connecting ring 44 extends across a bottom edge 43*b* of each blade 43, providing a structure with improved strength. Each blade 43 further includes an air inlet side edge 43*a*, 43*a*1 located on the air inlet side 40*a*, and the above-mentioned bottom edge 43*b* is located on the bottom side 40*b*.

Still referring to FIGS. 3 and 4, the air inlet side edges 43*a*1 of some of the blades 43 have an axial level lower than that of the air inlet side edges 43*a* of the remaining blades 43. Thus, the distribution of blades 43 at the air inlet side 40*a* of the impeller 4 is sparser than that at the bottom side 40*b* of the impeller 4. Preferably, the air inlet side edges 43*a* of the remaining blades 43 have an axial level above the hub 41 such that a buffering space 400 is defined between a top face of the hub 41 and the blades 43.

Figure 5:
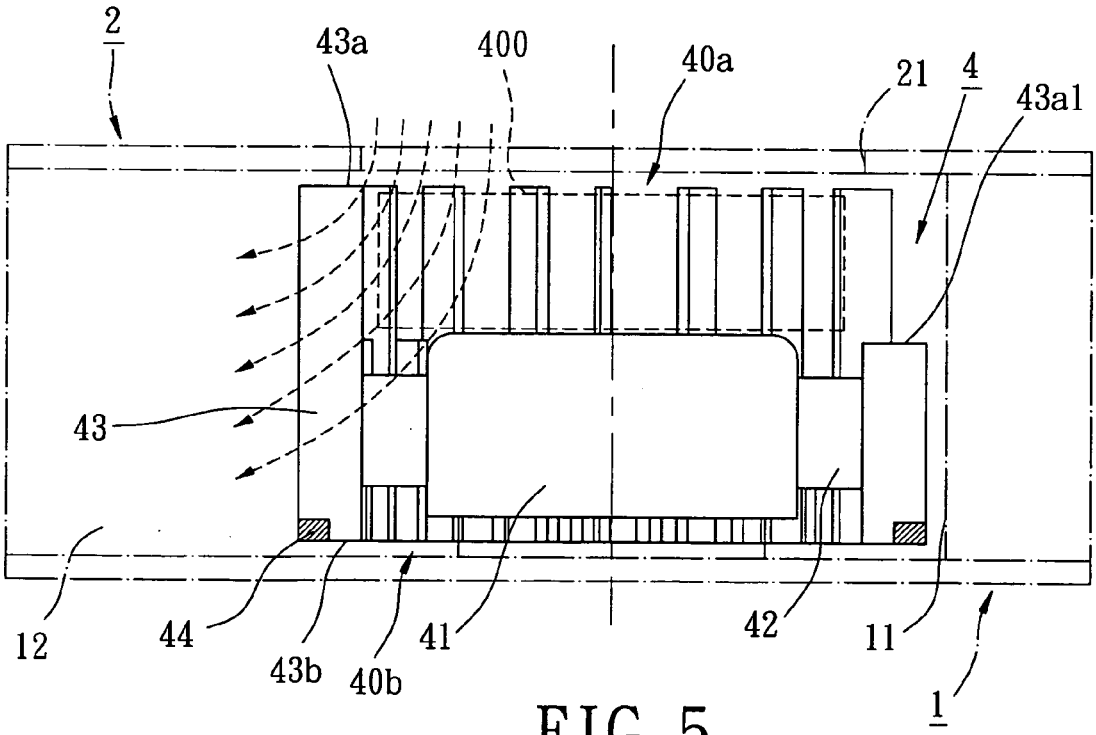
FIG. 5 is a view similar to FIG. 4, illustrating operation of the impeller.

Referring to FIG. 5, when the blades 43 of the impeller 4 turns, axial airflow is drawn into the buffering space 400 via the inlet 21 of the cover 2. Since the distribution of blades 43 at the air inlet side 40*a* of the impeller 4 is sparser than that at the bottom side 40*b* of the impeller 4, overdense distribution of blades 43 at the air inlet side 40*a* of the impeller 4 is avoided, effectively preventing interference to air inlet operation at the inlet 21 and enlarging the buffering space 400.

When the axial airflow enters the buffering space 400, the buffering space 400 provides an increased air inlet area as well as a sufficient space for smoothly changing the axial airflow into centrifugal airflow. Thus, pressurized centrifugal airflow is obtained and exits the casing 1 via the outlet 12.

Another advantages of the sparser distribution of blades 43 at the air inlet side 40*a* is that the lower portions of the blades 43 adjacent to the bottom side 40*b* have a greater air driving power such that the axial airflow tends to flow toward the lower portions of the blades 43. Namely, the directional change from the axial direction to the centrifugal direction is not completely carried out at the upper portions of the blades 43, which lowers the blowing noise of the blades 43.

Figure 6:
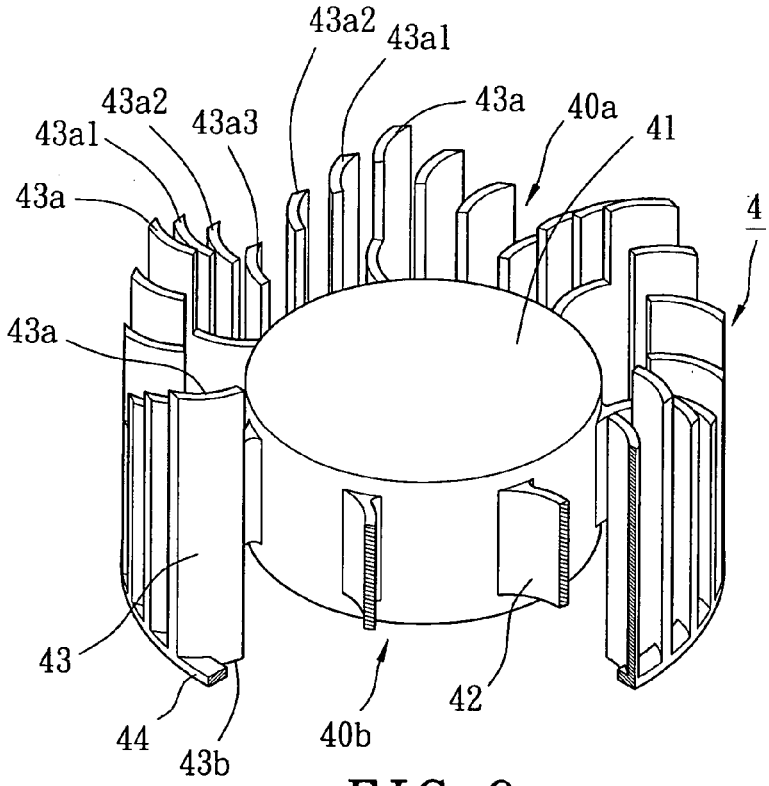
FIG. 6 is a perspective view, partly cutaway, illustrating a second embodiment of the impeller in accordance with the present invention.

FIG. 6 illustrates a second embodiment of the invention, wherein the blades 43 have air inlet side edges 43*a*, 43*a*1, 43*a*2, 43*a*3 at different axial levels. Preferably, the blades 43 with different axial levels are annularly equispaced. Similar to the first embodiment, the sparser distribution of blades 43 at the air inlet side 40*a* reduces interference to the air inlet operation at the inlet 21 (see FIG. 5) and increases the air inlet area. A buffering space is provided between the top face of the hub 41 and the blades 43 for further increasing the air inlet area, for smoothly changing the axial airflow into centrifugal airflow, and for lowering the blowing noise.

Figure 7:
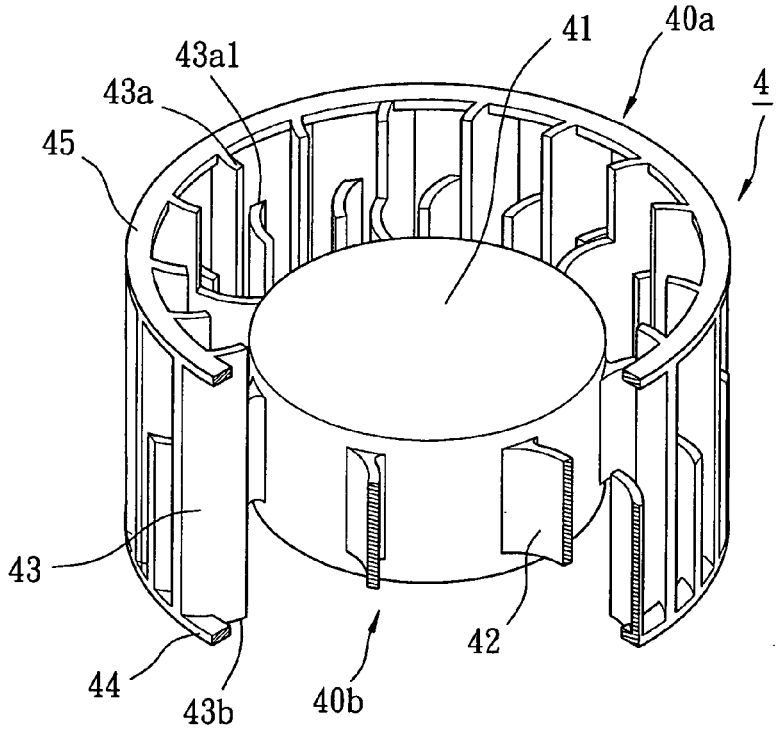
FIG. 7 is a perspective view, partly cutaway, of a third embodiment of the impeller in accordance with the present invention.

FIG. 7 illustrates a third embodiment of the invention, wherein the impeller 4 comprises a connecting ring 45 extending across the air inlet side edge 43*a* of the blades 43, thereby reinforcing the air inlet side 40*a* of the impeller 4. Further, the connecting ring 45 reduces the risk of inadvertent leakage of radial airflow via the inlet 21.

Figure 8:
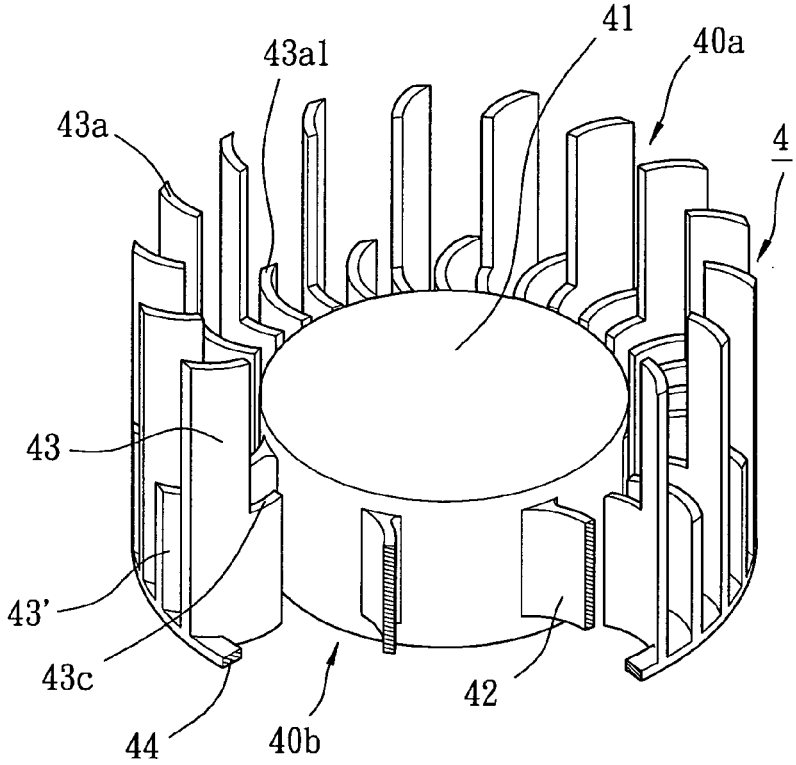
FIG. 8 is a perspective view, partly cutaway, of a fourth embodiment of the impeller in accordance with the present invention.

FIG. 8 illustrates a fourth embodiment of the invention, wherein each of the remaining blades 43 having a higher axial level (see air inlet side edge 43*a*) includes a stepped section 43*c* that has an axial level the same as that of the air inlet side edges 43*a*1 of the blades 43'. The distribution of blades 43, 43' at the air inlet side 40*a* of the impeller 4 is sparser than that in the above embodiments, further increasing the air inlet area while providing the lower portion of the blades 43 and the blades 43' with a greater air driving power.

Figure 9:
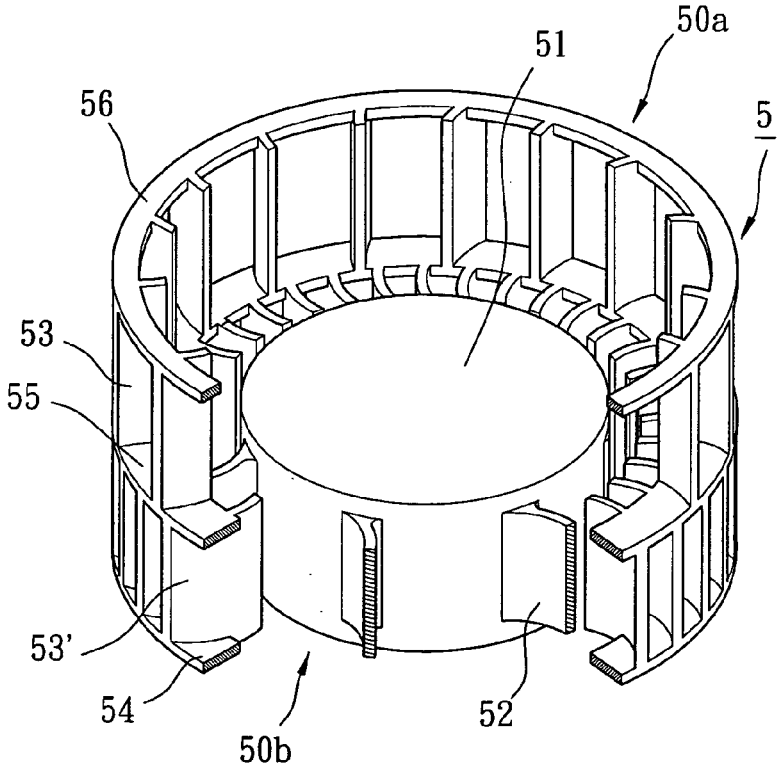
FIG. 9 is a perspective view, partly cutaway, of a fifth embodiment of the impeller in accordance with the present invention.

FIG. 9 illustrates a fifth embodiment of the invention, wherein the impeller 5 comprises a hub 51, at least one supporting member 52, a plurality of upper blades 53, a plurality of lower blades 54, and a plurality of connecting rings 54, 55, and 56. The impeller 5 includes an air inlet side 50*a* and a bottom side 50. The upper blades 53 and the lower blades 53' are connected and spaced by the connecting rings 54, 55, and 56. The number of the upper blades 53 are smaller than that of the lower blades 53'. Further, the radial length of each upper blade 53 is preferably smaller than that of each lower blade 53'. Thus, the distribution of the blades 53, 53' at the air inlet side 50*a* is sparser to increase the air inlet area while providing the lower blades 53' with a greater air driving power.

Figure 10:
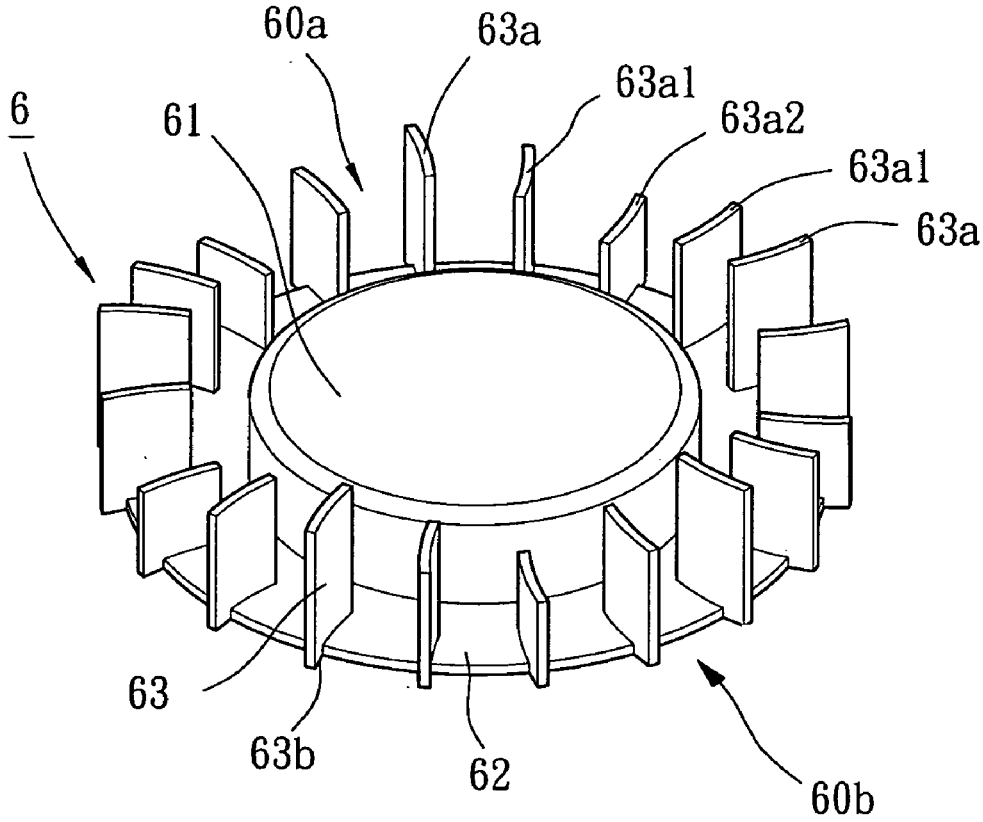
FIG. 10 is a perspective view, partly cutaway, of a fifth embodiment of the impeller in accordance with the present invention.
Figure 11:
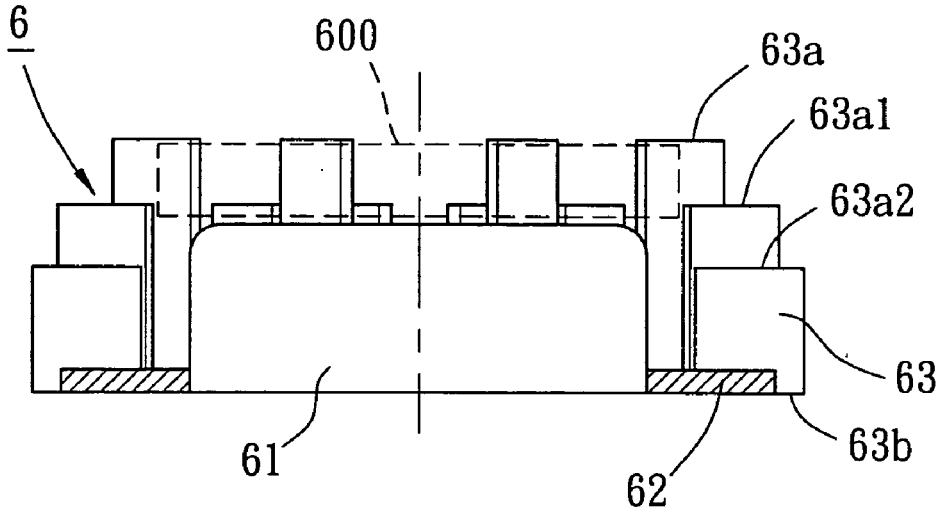
FIG. 11 is a sectional view of the impeller in FIG. 10.

FIGS. 10 and 11 illustrate a sixth embodiment of the invention, in this embodiment, the impeller 6 includes a hub 61, a plate-like supporting member 62 extending radially outward from a circumference of the hub 61, and a plurality of blades 63 provided on a side of the supporting member 62. The impeller 6 includes an air inlet side 60*a* and a bottom side 60*b*. The blades 63 have air inlet side edges 63*a*, 63*a*1, and 63*a*2 at different axial levels. Further, each blade 63 has a bottom edge 63*b*. Thus, the distribution of the blades 63 at the air inlet side 60*a* is sparser to reduce interference to the air inlet operation at the inlet 21. Further, some of the blades 63 have an axial level higher than the hub 61, providing a buffering space 600 between the blades 63 and the top face of the hub 61 for increasing the air inlet area, for smoothly changing the axial airflow into centrifugal airflow, and for lowering the blowing noise.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An impeller for a radial-flow heat dissipating fan, comprising:

a hub having a circumference;

a plurality of blades surrounding the hub, the blades including a first blade set and a second blade set; and at least one connecting member connecting the blades to the circumference of the hub and separating the blades from the circumference of the hub, said at least one connecting member comprising at least one rib;

the impeller including an air inlet side and a bottom side, wherein blades of the first blade set and the second blade set have a bottom edge located at the bottom side, and the blades of the first blade set extend beyond the blades of the second blade set at the air inlet side such that distribution of the blades at the air inlet side of the impeller is sparser than that at the bottom side of the impeller, thereby increasing an air inlet amount.

2. The impeller as claimed in claim 1, wherein each said blade of the first blade set includes an air inlet side edge, the air inlet side edges of the blades having different axial levels to form the sparser distribution of the blades at the air inlet side of the impeller.

3. The impeller as claimed in claim 1, wherein the blades include a plurality of higher blades to form the first blade set and a plurality of shorter blades to form the second blade set, the number of the shorter blades being more than that of the higher blades to form the sparser distribution of the blades at the air inlet side of the impeller.

4. The impeller as claimed in claim 1, wherein some of the blades have an axial level higher than the hub, forming a buffering space between the blades and a top face of the hub for increasing the air inlet area and for assisting in change of axial incoming airflow into centrifugal airflow.

5. The impeller as claimed in claim 1, wherein the impeller comprises an annular plate extending from the circumference of the hub to form the connecting member, and wherein said blades are mounted on a side of the annular plate.

6. An impeller for a radial-flow heat dissipating fan, comprising:

a hub having a circumference;

a plurality of blades surrounding the hub, the blades including a first blade set and a second blade set; and at least one connecting member connecting the blades to the circumference of the hub and separating the blades from the circumference of the hub;

the impeller including an air inlet side and a bottom side, wherein blades of the first blade set and the second blade set have a bottom edge located at the bottom side, and the blades of the first blade set extend beyond the blades of the second blade set at the air inlet side such that distribution of the blades at the air inlet side of the impeller is sparser than that at the bottom side of the impeller, thereby increasing an air inlet amount; and wherein the impeller further comprises a connecting ring extending across an air inlet side edge of each said blade which is disconnected from the outer circumference of the hub.

7. The impeller as claimed in claim 6, wherein the impeller further comprises another connecting ring extending across the bottom edge of each said blade.

8. The impeller as claimed in claim 7, wherein the impeller further comprises at least one supporting member to form the connecting member connected between the circumference of the hub and at least one of the blades.

9. The impeller as claimed in claim 6, wherein the impeller further comprises at least one supporting member to form the connecting member connected between the circumference of the hub and at least one of the blades.

10. An impeller for a radial-flow heat dissipating fan, comprising:

a hub having a circumference;

a plurality of blades surrounding the hub, the blades including a first blade set and a second blade set; and at least one connecting member connecting the blades to the circumference of the hub and separating the blades from the circumference of the hub;

the impeller including an air inlet side and a bottom side, wherein blades of the first blade set and the second blade set have a bottom edge located at the bottom side, and the blades of the first blade set extend beyond the blades of the second blade set at the air inlet side such that distribution of the blades at the air inlet side of the impeller is sparser than that at the bottom side of the impeller, thereby increasing an air inlet amount, and wherein the impeller further comprises a connecting ring extending across a bottom edge of each said blade.

11. The impeller as claimed in claim 10, wherein the impeller further comprises at least one supporting member to form the connecting member connected between the circumference of the hub and at least one of the blades.

12. An impeller, for a radial-flow heat dissipating fan, comprising:

a hub having a circumference;

a plurality of blades surrounding the hub, the blades including a first blade set and a second blade set; and at least one connecting member connecting the blades to the circumference of the hub and separating the blades from the circumference of the hub;

the impeller including an air inlet side and a bottom side, wherein blades of the first blade set and the second blade set have a bottom edge located at the bottom side, and the blades of the first blade set extend beyond the blades of the second blade set at the air inlet side such that distribution of the blades at the air inlet side of the impeller is sparser than that at the bottom side of the impeller, thereby increasing an air inlet amount;

wherein the blades include a plurality of higher blades to form the first blade set and a plurality of shorter blades to form the second blade set, the number of the shorter blades being more than that of the higher blades to form the sparser distribution of the blades at the air inlet side of the impeller; and wherein the impeller further comprises a connecting ring separating some of the blades to form upper blades and lower blades.

13. An impeller for a radial-flow heat dissipating fan, comprising:

a hub having a circumference;

a plurality of blades, each longitudinally extending along an axis of the hub, the blades varying in heights along the axis of the hub; and at least one connecting member connecting the blades to the circumference of the hub and separating the blades from the circumference of the hub, said at least one connecting member comprising at least one rib;

the impeller further including an air inlet side and a bottom side, wherein some of the blades longitudinally extend beyond other blades at the air inlet side.

14. The impeller as claimed in claim 13, wherein each said blade includes an air inlet side edge and a bottom edge, the air inlet side edges of the blades having various heights.

15. The impeller as claimed in claim 13, wherein the blades include a plurality of higher blades to form a first blade set and a plurality of shorter blades to form a second blade set, the number of the shorter blades being more than that of the higher blades.

16. The impeller as claimed in claim 13, wherein the impeller further comprises a connecting ring extending across an air inlet side edge of each said blade.

17. An impeller for a radial-flow heat dissipating fan, comprising:

a hub having a circumference;

a plurality of blades, each longitudinally extending along an axis of the hub, the blades varying in heights along the axis of the hub; and at least one connecting member connecting the blades to the circumference of the hub and separating the blades from the circumference of the hub;

the impeller further including an air inlet side and a bottom side, wherein some of the blades longitudinally extend beyond other blades at the air inlet side;

wherein the impeller further comprises a connecting ring extending across a bottom edge of each said blade.

18. The impeller as claimed in claim 17, wherein the impeller further comprises at least one supporting member to form the connecting member connected between the circumference of the hub and at least one of the blades.

19. The impeller as claimed in claim 17, wherein the impeller comprises an annular plate extending from the circumference of the hub to form the connecting member, and wherein said blades are mounted on a side of the annular plate.

20. An impeller, for a radial-flow heat dissipating fan, comprising:

a hub having a circumference;

a plurality of blades, each longitudinally extending along an axis of the hub, the blades varying in heights along the axis of the hub; and at least one connecting member connecting the blades to the circumference of the hub and separating the blades from the circumference of the hub;

the impeller further including an air inlet side and a bottom side, wherein some of the blades longitudinally extend beyond other blades at the air inlet side;

wherein the impeller further comprises a connecting ring separating some of the blades to form upper blades and lower blades.

* * * * *